United States Patent [19]

Glasa et al.

[11] 4,341,458

[45] Jul. 27, 1982

[54] THERMAL PRESSURE FIXING DEVICE

[75] Inventors: Winfried Glasa, Frankfurt; Peter Gumm, Glashütten, both of Fed. Rep. of Germany

[73] Assignee: Hoechst Aktiengesellschaft, Frankfurt am Main, Fed. Rep. of Germany

[21] Appl. No.: 199,663

[22] Filed: Oct. 22, 1980

[30] Foreign Application Priority Data

Oct. 26, 1979 [DE] Fed. Rep. of Germany ..... 2943344

[51] Int. Cl.[3] ..... G03G 15/20

[52] U.S. Cl. ..... 355/3 FU; 219/216; 219/388; 432/60; 432/228

[58] Field of Search ..... 355/3 FU, 14 FU; 219/216, 388; 432/60, 61, 62, 228; 430/98, 99, 124; 100/168, 172

[56] References Cited

U.S. PATENT DOCUMENTS

| | | | |
|---|---|---|---|
| 3,256,002 | 6/1966 | Hudson | 432/62 X |
| 3,291,466 | 12/1966 | Aser et al. | 432/62 X |
| 3,331,592 | 7/1967 | Cassano | 432/60 |
| 3,452,181 | 6/1969 | Stryjewski | 219/216 |
| 3,754,819 | 8/1973 | Braun | 219/216 X |
| 3,794,417 | 2/1974 | Machmer | 355/14 FU |
| 3,810,776 | 5/1974 | Banks et al. | 219/216 X |
| 3,834,861 | 9/1974 | McCarroll | 432/60 |
| 3,907,493 | 9/1975 | Thettu | 432/288 X |
| 4,162,847 | 7/1979 | Brandon | 219/216 X |
| 4,272,666 | 6/1981 | Collin | 355/3 FU |

FOREIGN PATENT DOCUMENTS

| | | | |
|---|---|---|---|
| 632 | 7/1979 | European Pat. Off. | 432/228 |
| 2399686 | 3/1979 | France . | |

*Primary Examiner*—Richard L. Moses

*Attorney, Agent, or Firm*—Schwartz, Jeffery, Schwaab, Mack, Blumenthal & Koch

[57] ABSTRACT

Disclosed is a thermal pressure fixing device for a copier, comprising a pressure roll and a fixing roll for heating and pressing an image-receiving material carrying a toner image, whereby during the passage of the image-receiving material between the rolls the latter are in pressure contact with each other, whereas during a standstill of the copier or in the case of a copier malfunction, the pressure of the rolls is discontinued. There are provided a device for lifting the pressure roll toward the fixing roll and for separating the two rolls, and a clutch and brake mechanism interacting with this device. Resilient elements adapt the center distance between the pressure roll and the fixing roll to the changes occurring in diameter of these rolls, in such a way that the preset roll pressure between the rolls remains constant.

24 Claims, 5 Drawing Figures

THERMAL PRESSURE FIXING DEVICE

BACKGROUND OF THE INVENTION

The present invention relates to a thermal pressure fixing device for a copying machine, comprising a pressure roll and a fixing roll for heating and pressing an image receiving material, which carries a toner image. During the passage of the image receiving material between the two rolls, the latter are pressed against each other, and this pressure contact is neutralized when the copier is shut off or a malfunction occurs within the copier.

Such a thermal pressure fixing device, comprising a pair of rolls for heating and pressing a copying material carrying a toner image, is described in German Offenlegungsschrift No. 26 52 731. In this device, a toothed control wheel is provided which mates with a toothed planetary wheel rotating around the toothed control wheel. The toothed planetary wheel is driven by a special mechanism, and there is also a mechanism provided which reacts to the rotary movement of the toothed planetary wheel, in order to shift the pair of rolls between a first position where the rolls are pressed against each other, and a second position where the pressure is released. This known fixing device has three rolls, namely a fixing roll, a heating roll and a pressure contact roll. The two latter rolls are equipped with internal heating means. This device solves the problem of releasing the pressure during a standstill or in case of a malfunction of the copier; however, the rolls are not separated from each other. Rather, the heated rolls and the fixing roll remain in a slight, pressureless contact, even when no fixing process goes on, whereby the fixing roll is uniformly heated by the two other rolls and, is kept at a predetermined temperature.

A complete separation of the rolls is not provided, nor is there taken into consideration a change in the external diameters of the silicone rubber coated or tetrafluoroethylene resin (Teflon) coated rolls. Despite constant center distances of the rolls, the roll pressure may—due to swelling of the coating materials—increase to such an extent that even during the standstill of the copier, i.e., when the rolls just slightly contact each other, pressures occur which are so high as to lead to a considerably shortened operational life of the rolls.

German Offlegungsschrift No. 27 58 245 describes a thermal pressure fixing device, wherein a slight pressure contact between a pressure roll and a fixing roll is maintained by associated means while the copier is switched off, and also at the moment, or up to the moment where it is switched on. The pressure roll moves vertically up and down, and the ends of its shaft are supported by bearing elements in such a way that the weight of the roll is carried by pressure levers. Below the pressure levers are provided cam-type, curved bearing surfaces which are in contact with the undersides of the levers. When no fixing is being carried out, the levers contact the flat sections of the curved surfaces. During the fixing process, the levers contact the higher, i.e., the steeper sections, of the curved surfaces, and thus press the pressure roll against the cylindrical surface of the heating roll at a high compressive force.

SUMMARY OF THE INVENTION

It is therefore an object of the present invention to provide an improved thermal pressure fixing device.

It is another object of the invention to provide a thermal pressure fixing device, in which during a standstill or in case of malfunction of the copier, no thermal or mechanical loads of the resiliently coated pressure roll occur and thus the changes in pressure between the rolls, which usually occur due to the variation in the external diameters of the rolls caused by swelling or shrinking of the coating materials due to fluctuations in temperature, and/or to ageing processes, are compensated for.

In accomplishing the foregoing objects, there has been provided in accordance with the present invention a fixing roll and a pressure roll, the pressure roll being slideably positioned adjacent to the fixing roll; a device for lifting the pressure roll toward the fixing roll and for separating the two rolls; resilient elements positioned in contact with bearing plates of the fixing roll; and a clutch and brake mechanism fitted on a shaft carrying the lifting and separating device. Preferably, the resilient elements position the center distance between the pressure roll and the fixing roll.

The lifting and separating device, the pressure roll and the fixing roll, preferably are arranged vertically one above another, so that the lower ends of the resilient elements are in contact with the upper sides of the bearing plates of the fixing roll.

According to one preferred embodiment, the resilient elements comprise sets of cup springs whose upper ends press against screws by means of which the nominal pressure of the sets of cup springs is adjustable. The cup springs have degressive characteristics which act against an increasing roll pressure which may arise due to changes in the diameter of the fixing or pressure roll, by causing the fixing roll to slide upwardly, thus maintaining the initial set pressure of the rolls. Other objects, features and advantages of the invention will become apparent from the detailed description of preferred embodiments which follows, when considered together with the attached drawings.

DETAILED DESCRIPTION OF PREFERRED EMBODIMENTS

The device according to the invention and the mode of operation of the embodiments are explained in detail, without being limited to the illustrated preferred embodiments.

The present invention provides a device for lifting the pressure roll to the fixing roll and for separating the two rolls, by providing a clutch and brake arrangement interacting with this device, and by resilient elements which regulate the center distance between the pressure roll and the fixing roll in such a way that the roll pressure remains constant, even in case of changes in the roll diameter.

The lifting device, the pressure roll and the fixing roll are arranged vertically one above another and the lower ends of the resilient elements are in contact with the upper surfaces of the bearing plates of the fixing roll. The lifting device consists of two cam disks which are arranged on a common shaft at a distance larger than the width of the pressure roll, and are adjacent to ball bearings which are located on the shaft of the pressure roll.

The resilient elements are sets of cup springs, the upper ends of which are adjacent to screws, by means of which the nominal compressive force of the cup springs can be adjusted.

Figure 1:
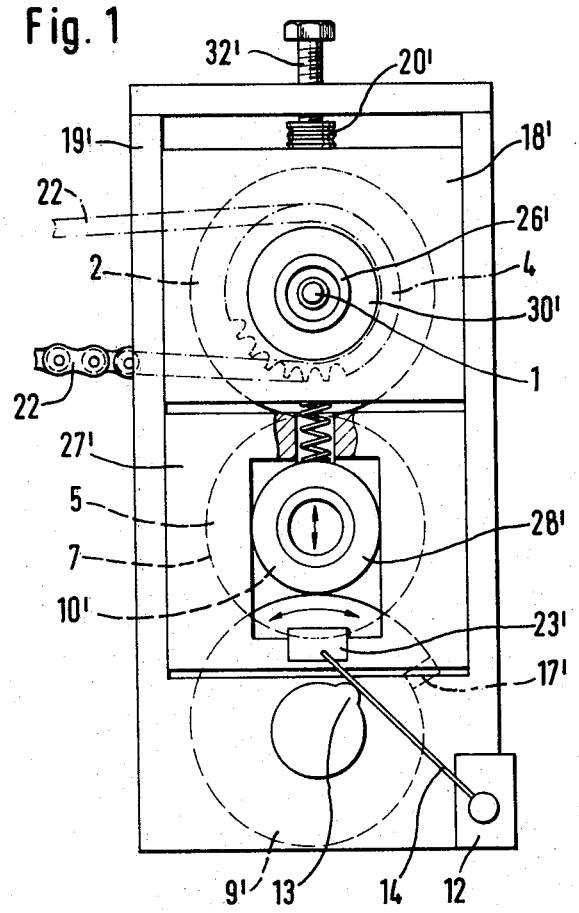
FIG. 1 is a schematic front view of an embodiment of the thermal pressure fixing device according to the invention.
Figure 1A:
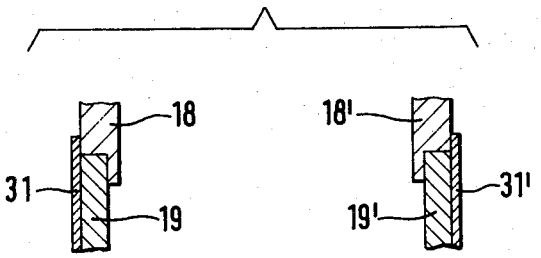
FIG. 1*a* is a section view of a detail of bearing plates and side parts of the frame of the fixing device.
Figure 2:
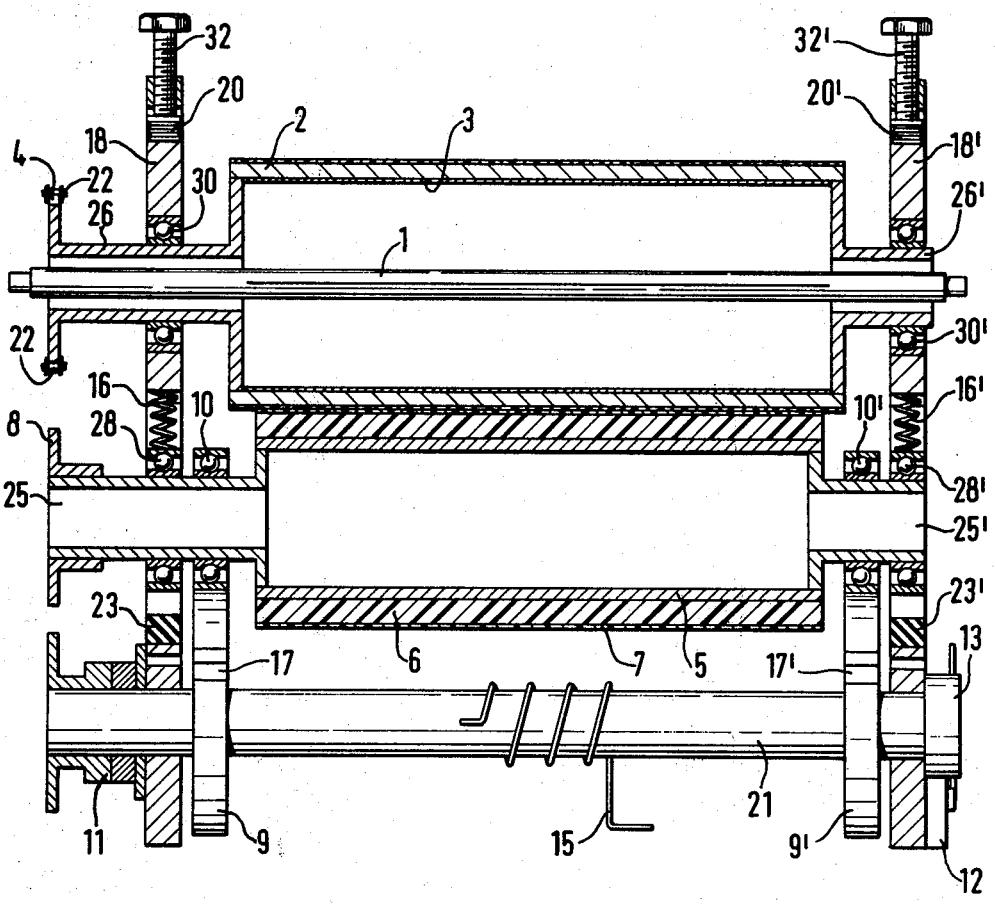
FIG. 2 is a schematic section side view of the embodiment according to FIG. 1.

The thermal pressure fixing device shown in FIGS. 1 and 2 comprises a fixing roll 2, a pressure roll 5 which is adjacent to the underside of the fixing roll 2, and a lifting and separating device consisting of two cam disks 9, 9', by means of which the pressure roll 5 is pressed against the fixing roll 2, or is respectively separated from the latter. The fixing roll 2 has two shaft necks 26, 26'. One of the shaft necks 26 projects more from its respective end surface of the fixing roll 2 than the other shaft neck 26' does from the other end surface. The shaft necks 26, 26' are supported in bearing plates 18, 18' by means of ball bearings 30, 30', which are slideable in a link frame 19. This frame consists of two side parts and an upper part, whereby each of these parts has a U-shaped section which is opened toward the front surfaces of the rolls. The U-shaped sections of the side parts of the link frame 19 form rails for the vertical up-and-down sliding of the bearing plates 18, 18'. Guidance of the bearing plates 18, 18' may also be effected by providing angular recesses on both vertical sides of the bearing plates 18, 18', in which the side parts of the frame 19 engage (see FIG. 1*a*). The side parts are secured against axial shifting by metal sheets 31, 31'. On the shaft neck 26 projecting more from the end surface of the fixing roll 2, a toothed wheel 4 is installed which via a link-belt chain 22 is driven by the drive of the copier, which is not shown in the drawing, however. Thus, the fixing roll 2 is driven at the processing speed of the copier by means of the linkbelt chain 4.

In the interior of the fixing roll 2 is provided a heating device 1, which heats the cylindrical surface of the fixing roll 2 by radiation from inside. The core of the fixing roll 2 is rigid and has an internal metal lining 3 which encloses the heating device 1 and thus prevents corrosion. The internal lining 3 may, for example, by hot-galvanized. The surface area of the fixing roll 2 is coated with an appropriate polytetrafluoroethylene material which, in interaction with a release agent, e.g., a silicone oil, and if the correct temperature range is properly chosen, prevents the sticky melted toner from adhering to the surface. The pressure roll 5, which is vertically declutchable, in general has a smaller outer diameter than the fixing roll 2. The roll 5 has a rigid core, which is covered with a heat-resistant silicone rubber layer 6 which is coated with a polytetrafluoroethylene tube 7, in order to improve the anti-adhesive behavior toward toner and to avoid the penetration of silicone oil into the silicone rubber layer 6. This polytetrafluoroethylene tube 7 may be glued on. On the shaft necks 25, 25' of the pressure roll 5, which are of different lengths, ball bearings 28, 28' are installed which are guided in the link frame 19 and are slidable up and down vertically in the U-shaped side parts of the link frame 19. Above the shaft necks 25, 25', pressure springs 16, 16' are provided, the lower ends of which are supported by the ball bearings 28, 28', whereas their upper ends are supported against the bearing plates 18, 18'. In FIG. 2, elastic supports 23, 23' are shown which are installed in the frame 19 below the bearings 28, 28' and serve as damping buffers for the shaft necks 25, 25' of the pressure roll 5 when moving downwardly. The end surface of the shorter shaft neck 25' is flush with the outer surface of the link frame 19, whereas the longer shaft neck 25 projects from the frame 19 and carries an override clutch which connects the pressure roll 5 with the drive of the copier and ensures identical circumferential speeds of the pressure roll 5 and the fixing roll 2 during the fixing process. Between the end surfaces of the pressure roll 5 and the inner sides of the frame 19, ball bearings 10, 10' are mounted on the two shaft necks 25, 25' of the roll 5. The cam disks 9, 9' act upon these ball bearings 10, 10' whereby the friction is reduced and the return of the cam disks 9, 9' is facilitated and made sure, as soon as the fixing roll 2 and the pressure roll 5 are separated from each other in case of the standstill or malfunction of the copier. By the separation of the two rolls, high local thermal loads are avoided, whereby the operation life of the pressure roll 5 can be considerably prolonged.

The two cam disks 9, 9' are arranged upon a shaft 21, at a distance greater than the width of the pressure roll 5. Each cam disk is provided with an elastic damping element 17, 17', for example, a rubber bumper, which absorbs and elastically damps the return movement of the cam disks and the pressure roll 5 to their initial positions after finishing the fixing process.

A resetting spring 15 is installed on the common shaft 21 of the cam disks 9, 9', which enhances the return of the cam disks 9, 9' to their starting position after ending of the fixing process or in the case of a copier malfunction. The pressure springs 16, 16' make sure that the pressure roll 5 is pressed down and contacts the cam disks 9, 9' upon the reset of the latter to their starting position.

An electrically operated clutch and brake mechanism 11 is positioned on the shaft 21 of the cam disks 9, 9'. This mechanism releases the cam disks 9, 9' when it is switched off, so that, e.g., after termination of the fixing process, the setting spring 15 leads the cam disks 9, 9' back to their starting position, where additional braking takes place. This braking is effected after the cam disks 9, 9' have gone through an adjustable angle of rotation. On the end of the shaft 21 which is opposed to the end where the clutch and brake mechanism 11 is installed, there is mounted a cam 13 which during the rotation of the shaft 21 comes into contact with a lug 14 of a limit switch 12 and operates this switch, in order to slow down the rotation of the shaft 21 by means of the clutch and brake unit 11 which is electrically connected with and actuated by the limit switch 12. The position of this cam toward the cam disks 9, 9' can be changed by twisting, so that the angle of rotation which the cam disks 9, 9' must go through before actuation of the lug 14 of the limit switch 12 is adjustable. After termination of the fixing process, or in the case of a malfunction, the electrical supply of the clutch and brake mechanism 11 is interrupted, and the pressure roll 5 returns to its initial position where it is separated from the fixing roll 2. The resetting of the pressure roll 5 is caused by the cam disks which likewise return to their starting position and by the pressure of the pressure springs 16, 16'.

With their lower ends, resilient elements 20, 20', e.g., sets of cup springs, are in contact with the upper sides of the bearing plates 18, 18' of the fixing roll 2. The nominal pressure being exerted by these cup springs is created by screws 32, 32' which are led through the upper part of the link frame 19. The lower ends of the screws 32, 32' contact the cup spring sets 20, 20'. These sets of cup springs have degressive or diminishing characteristics which act against an increasing roll pressure which occurs due to an increase in diameter of one of the rolls 5 and 2, by moving the fixing roll 2 upwardly. Thus, the initial pressure of the rolls 2 and 5 is maintained. Changes in the diameter of the pressure roll 5 or alternatively of the fixing roll 2 are caused by the fact that the diameter of the silicone rubber coating 6 of the pressure roll 5 changes at rising temperatures. Changes in diameter are also caused by ageing. Such changes may also occur in the polytetrafluoroethylene layer of the fixing roll 2 and become noticeable when this layer has a certain thickness. The change in diameter of one of the rolls results in that the pressure zone and thus the fusing time do not remain constant if a fixed center distance is kept between the fixing roll 2 and the pressure roll 5. This also causes an increasing roll pressure which not only leads to a shorter life of the rolls, but also to a subsequent offset printing of the thermal pressure fixing device. As is known, "offset" printing, i.e., part of the toner image adheres to the roll surface, occurs if the toner temperature does not lie within a certain range during the fusing process. The fixing roll 2 then acts in a way similar to an "offset" printing roll and transfers part of the preceeding copy to the next one. Two kinds of offset effect are distinguished. If due to overheating and overpressure the toner gets too liquid, the cohesion forces are not sufficient to even surmount the low adhesion forces toward the heating roll surface, and "hot offset" will be the result. In case of insufficiently fused toner particles it is found that they rather have a tendency to adhere to the roll surface than to the image-receiving material, so that "cold offset" is the result. The optimum fixing temperatures and contact times depend on the toner used and on the process speed of the respective copier. These setting values must remain constant for single-copy operation and for continuous operation, which can only be achieved if the pressure zone width and the interrelated fusing time remain constant. By means of the cup spring sets 20, 20' having degressive characteristics, the center distance between the fixing roll 2 and the pressure roll 5 is continuously adapted to the changes in diameter of either one of the two rolls. By this it is guaranteed that the roll pressure and thus the width of the pressure zone remain almost constant, regardless of the actual outer diameters of the two rolls 2 and 5. As soon as the outer diameter of one of the two rolls grows, the degressive characteristic line of the cup spring sets 20, 20' allows the fixing roll 5 to escape in the upward direction, against the pressure of the cup spring sets, and the roll pressure thus remains constant. The desired nominal pressure between the two rolls 2 and 5 is set by means of the screws 32, 32' which are in contact with the upper side of the cup spring sets 20, 20'.

Figure 3:
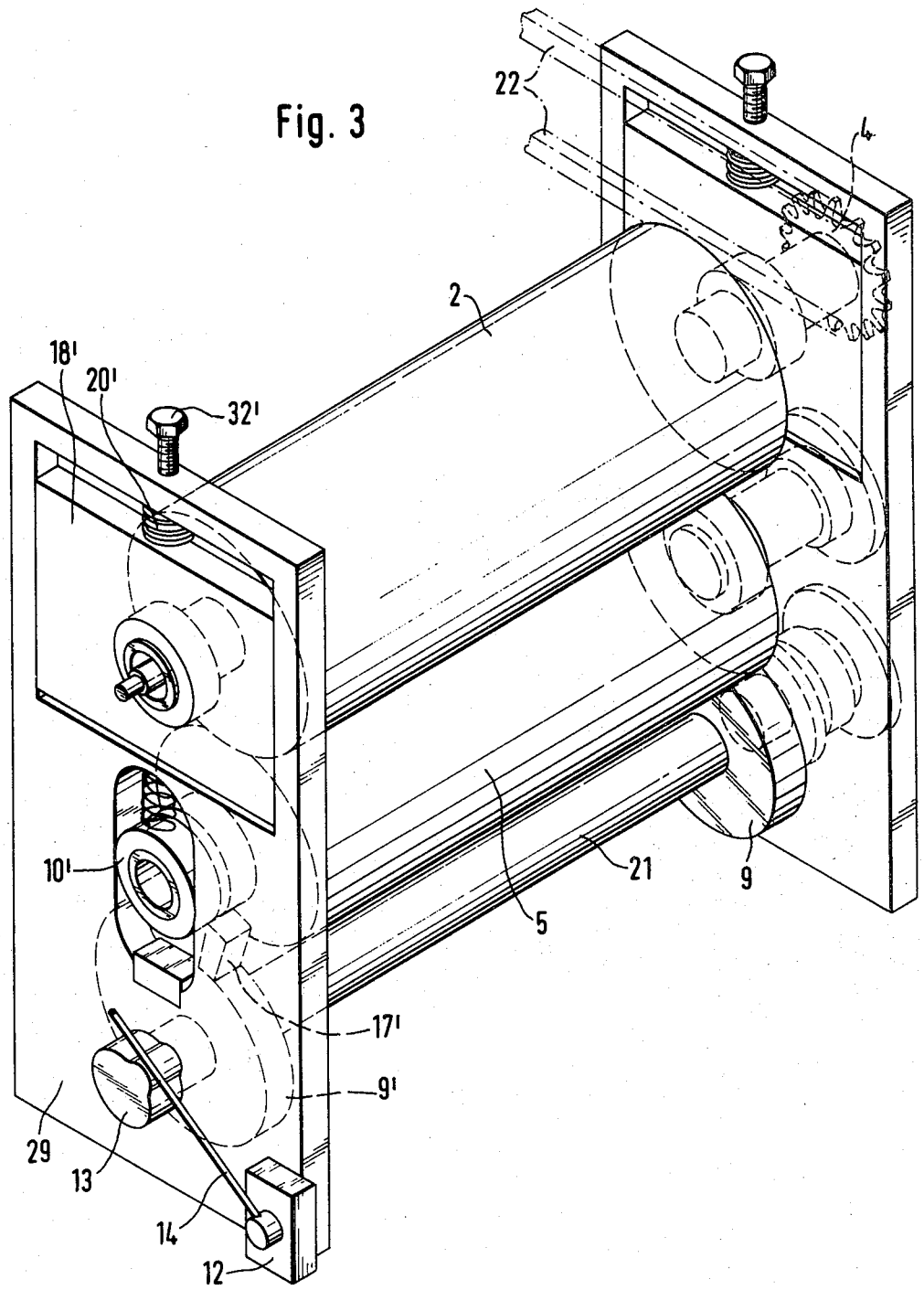
FIG. 3 is a perspective view of a further embodiment according to the invention.
Figure 4:
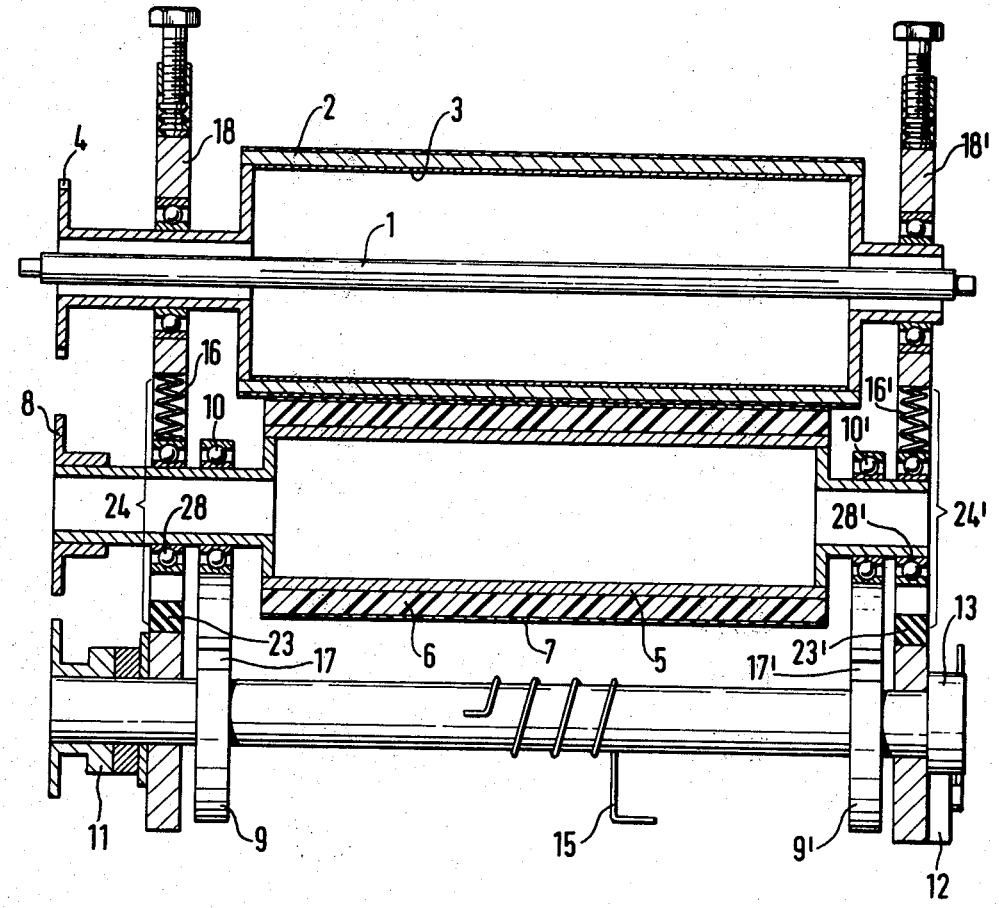
FIG. 4 is a schematic section side view of the embodiment according to FIG. 3.

In the embodiment as shown in FIGS. 3 and 4, those parts which are identical with the embodiment as shown in FIGS. 1 and 2 are designated by the same reference numerals. The difference compared with the embodiment according to FIGS. 1 and 2 is that, instead of the link frame 19 having side parts with U-shaped sections throughout, a frame 29 is provided wherein the side parts have a U-shaped section in their upper thirds only, in order to receive the bearing plates 18, 18' of the fixing roll 2, whereas below, the side parts have full walls. Each of these two lower parts of the sides of the frame 29 is provided with a slotted hole 24, respectively 24', through which the shaft necks 25, 25' of the pressure roll 5 extend. By means of the cam disks 9, 9' the pressure roll 5 can be moved up and down vertically in the slotted holes 24, 24'. In each of the slotted holes 24, 24' a pressure spring 16, 16' is arranged whose upper end presses against the end surface of the slotted hole, whereas its lower end presses against the ball bearing 28, or respectively 28' being installed on the shaft neck 25, or respectively 25' of the pressure roll 5. By the cam disks 9, 9' the pressure roll 5 is pressed onto the fixing roll 2, against the pressure of the springs 16, 16' and the cup spring sets 20, 20'. Elastic supports 23, 23' are mounted at the lower ends of the slotted holes 24, 24' as damping buffers for the pressure roll 5 when it moves downwardly after the fixing process. The downward movement of the pressure roll 5 is started by the return of the cam disks 9, 9' to their initial positions after fixing or if the copier malfunctions.

The other parts incorporated in this embodiment of the invention are the same as in the embodiment according to FIGS. 1 and 2, and therefore, a detailed explanation is omitted.

What is claimed:

1. A thermal pressure fixing device for a copier, comprising:

a fixing roll and a pressure roll, said pressure roll being slideably positioned adjacent to said fixing roll;

means, including a shaft and a clutch and brake mechanism fitted on said shaft, for moving said pressure roll towards said fixing roll during a thermal pressure fixing step and for separating said pressure and fixing rolls when the copier malfunctions or is shut off;

means, including at least one resilient element in contact with said fixing roll, for adjusting the distance between the axes of said rolls to maintain a constant pressure between said rolls by compensating for changes in roll diameter; and bearing plates for said fixing roll, wherein the lower ends of the resilient elements are in contact with upper sides of said bearing plates for said fixing roll.

2. A device according to claim 1, wherein said resilient element adjusts the center distance between said pressure roll and said fixing roll.

3. A device according to claim 1, wherein said fixing roll, said pressure roll and said moving means are arranged vertically one above another.

4. A device according to claim 1, wherein said pressure roll comprises a rigid core provided with a heat-resistant silicone rubber coating which is coated with a polytetrafluoroethylene tubing.

5. A device according to claim 1, wherein said moving means comprises two cam disks positioned on said shaft at a distance greater than the width of said pressure roll.

6. A device according to claim 5, wherein the pressure roll comprises opposing shaft necks, on which first ball bearings are positioned, which are in contact with said disks of said moving and separating means.

7. A device according to claim 5, wherein each cam disk includes an elastic damping element.

8. A device according to claim 7, further comprising a frame and wherein said shaft of the cam disks and said shaft necks of the pressure roll and the fixing roll are embedded in side parts of said frame.

9. A device according to claim 8, wherein each of the two side parts of said frame is provided with a slotted hole through which said shaft necks of the pressure roll pass, and wherein said shaft necks of the pressure roll are movable up and down vertically within the slotted holes by means of said cam disks.

10. A device according to claim 9, wherein in each slotted hole a pressure spring is positioned having its upper end pressing against one end surface of the slotted hole, and its lower end pressing against second ball bearings on said shaft necks of said pressure roll.

11. A device according to claim 9 or 10, wherein at the lower end of each slotted hole an elastic support is mounted which serves as damping buffer for the pressure roll moving downwardly.

12. A device according to claim 10, further comprising an override clutch installed on said shaft neck or said pressure roll, said override clutch connecting said pressure roll with the drive of the copier to ensure identical circumferential speeds of said pressure roll and said fixing roll during the fixing process.

13. A device according to claim 5, wherein on said shaft carrying said cam disks a resetting spring is positioned which enhances the reset of the cam disks to their initial position after the termination of the fixing process or in case of a malfunction occurring in the copier.

14. A device according to claim 7, further comprising means for adjusting the angle of rotation for the cam disks to provide a present angle and wherein the clutch and brake mechanism couples the shaft of the disks with the drive of the copier and brakes the cam disks as soon as they have passed through said preset angle of rotation.

15. A device according to claim 14, further comprising a switch cam mounted on said shaft and a limit switch having a lug positioned adjacent to said switch cam such that said switch cam comes into contact with said lug during rotation of said shaft and switches it in order to slow down the rotation of the shaft, and wherein the clutch and brake mechanism is electrically connected with said limit switch and actuated thereby.

16. A device according to claim 15, wherein the position of said switch cam with respect to said cam disks and thus the angle of rotation from the starting position of the cam disks through the actuation of the lug of the limit switch is adjustable.

17. A device according to claim 1 or 2, wherein the resilient element comprises a set of cup springs and a screw pressing against the upper end of the spring for adjusting the nominal pressure of the set of cup springs.

18. A device according to claim 17, wherein the set of cup springs have degressive characteristics which act against an increasing roll pressure which arises due to changes in the diameter of the fixing or pressure roll by causing the fixing roll to slide upwardly thus maintaining the initial set pressure of the rolls.

19. A device according to claim 1, wherein said fixing roll comprises a polytetrafluoroethylene coating upon a rigid core having a metallic internal lining surrounding a heating device.

20. A device according to claim 8 or 19, wherein one shaft neck of said fixing roll carries a gear wheel which is connected via a gear chain with the device of the copier.

21. A device according to claim 1, wherein the outer diameter of said pressure roll is smaller than that of said fixing roll.

22. A device according to claim 10, wherein said pressure roll includes third ball bearings supporting same and each of the two side parts of the frame has a U-shaped cross-section which is open toward the inside, and wherein these side parts receive said bearing plates and said second ball bearings of said fixing roll and said third ball bearings of the pressure roll in such a way that said pressure roll can be moved up and down within the side parts.

23. A device according to claim 22, wherein the shaft necks of said pressure roll are supported by means of said second ball bearings.

24. A device according to claim 22 or 23, wherein the lower ends of said pressure springs press against said second ball bearings and the upper ends of said pressure springs press against said bearing plates of said fixing roll.

* * * * *

UNITED STATES PATENT AND TRADEMARK OFFICE

CERTIFICATE OF CORRECTION

PATENT NO. : 4,341,458

DATED : July 27, 1982

INVENTOR(S) : Winfried GLASA, Peter GUMM

It is certified that error appears in the above—identified patent and that said Letters Patent is hereby corrected as shown below:

Column 8, line 24, kindly delete "device" and insert therefore -- drive --.

Signed and Sealed this

Nineteenth Day of October 1982

[SEAL]

Attest:

GERALD J. MOSSINGHOFF

Attesting Officer

Commissioner of Patents and Trademarks